United States Patent [19]

Thompson

[11] Patent Number: 4,882,793

[45] Date of Patent: Nov. 28, 1989

[54] DUAL FLUSH CISTERN MECHANISM

[75] Inventor: Bruce R. Thompson, Tranmere, Australia

[73] Assignee: Caroma Industries, Ltd., Norwood, Australia

[21] Appl. No.: 249,669

[22] Filed: Sep. 27, 1988

Related U.S. Application Data

[63] Continuation of Ser. No. 109,559, Oct. 19, 1987, abandoned.

[30] Foreign Application Priority Data

Oct. 20, 1986 [AU] Australia ..... PH8591
Jan. 8, 1987 [AU] Australia ..... PH9798

[51] Int. Cl.[4] ..... E03D 1/14; E03D 3/12

[52] U.S. Cl. ..... 4/324; 4/325; 4/381; 4/383; 4/390; 4/415

[58] Field of Search ..... 4/324, 325, 326, 327, 4/383, 384, 385, 415, 378, 390, 380, 381, 395, 396, 410

[56] References Cited

U.S. PATENT DOCUMENTS

| | | | |
|---|---|---|---|
| 3,153,247 | 10/1964 | Walsh | 4/325 |
| 3,968,525 | 7/1976 | Alexander | 4/410 |
| 4,032,997 | 7/1977 | Phripp et al. | 4/415 |
| 4,527,296 | 7/1985 | Musgrove | 4/324 |
| 4,651,359 | 3/1987 | Battle | 4/324 |

FOREIGN PATENT DOCUMENTS

| | | |
|---|---|---|
| 42966 | 1/1978 | Australia . |
| 43599 | 1/1979 | Australia . |
| 91874 | 12/1982 | Australia . |
| 24255 | 8/1984 | Australia . |
| 2601282 | 7/1977 | Fed. Rep. of Germany . |
| 2077790 | 12/1981 | United Kingdom . |

*Primary Examiner*—Henry K. Artis
*Attorney, Agent, or Firm*—Wegner & Bretschneider

[57] ABSTRACT

The present invention discloses a dual flush cistern mechanism in which a hollow central stem functions as a flush valve operating member, a slide for a float and an overflow pipe. The float is retained on the stem by a releasable latch during normal operation. During reduced volume flush operation the latch is released, the float drops with the level of water in the cistern sliding along the raised stem until it strikes a projection thereby lowering the stem and prematurely closing the flush valve.

9 Claims, 3 Drawing Sheets

DUAL FLUSH CISTERN MECHANISM

This application is a continuation of U.S. application Ser. No. 109,559 filed Oct. 19, 1987 now abandoned.

The present invention relates to cistern mechanisms and, in particular, to a dual flush cistern mechanism.

Dual flush cistern mechanisms are known per se in order to provide the advantageous function of either a small volume flush or a "normal" large volume flush. Considerable savings in water utilisation are able to be achieved thereby.

In order to be economically cost competitive, dual flush cistern mechanisms must be able to be fabricated by means of low cost procedures such as plastics moulding and should be able to be easily assembled. These two desiderata can be achieved if one or more of the components of the cistern mechanism have at least two operational functions.

It is the object of the present invention to provide a dual flush cistern mechanism in which a stem which operates a flush valve seal, also functions as a slide for a float. Preferably the stem is hollow and also functions as an overflow pipe.

According to one aspect of the present invention there is disclosed a dual flush cistern mechanism for a cistern, said mechanism comprising a substantially vertical stem mounted for substantially vertical movement above a flush valve of said cistern and having a flush valve seal located at its lower end; a float slidably mounted on said stem intermediate the ends thereof; a first lever arm pivotably connected to said stem at a location spaced from a first pivot in said cistern for said first lever arm, and being pivotable by each of a first and a second operating mechanism to raise said stem to open said flush valve; a second lever arm pivotable by said second operating mechanism about a second pivot in said cistern and carrying a latch member releasably engageable with said float to retain said float in a first, high operating position, and a projection extending from said stem to limit the travel of said float into a second low operating position; wherein said first operating mechanism is operable to raise said stem with said float retained in said high operating position by said latch member to open said flush valve for a first duration; and wherein said second operating mechanism is operable to substantially simultaneously raise said stem to open said flush valve to drain water from said cistern and release said latch member whereby said float drops with the waterlevel in said cistern until said float engages said stem projection to move said stem downwardly and close said flush valve before the expiration of said first duration, said float being buoyantly movable from said low to said high position to re-engage said latch member with said float when said cistern is re-filled with water.

Figure 1:
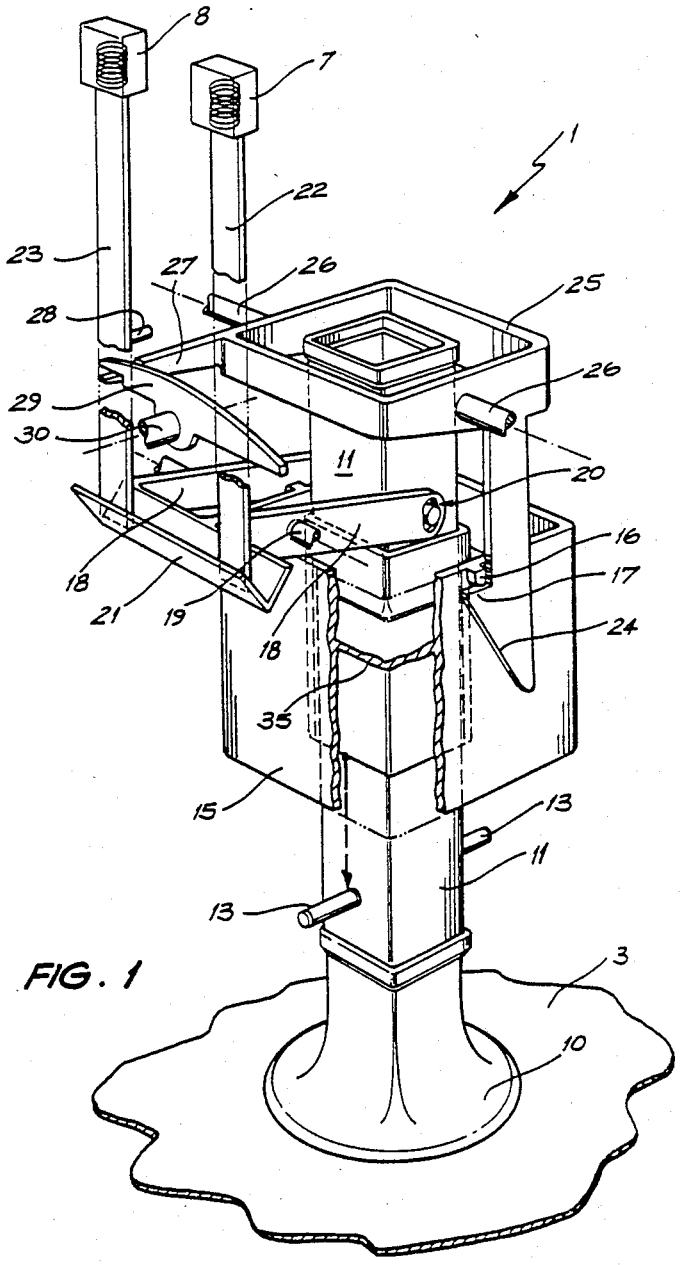
Figures 2A, 2B, 2C:
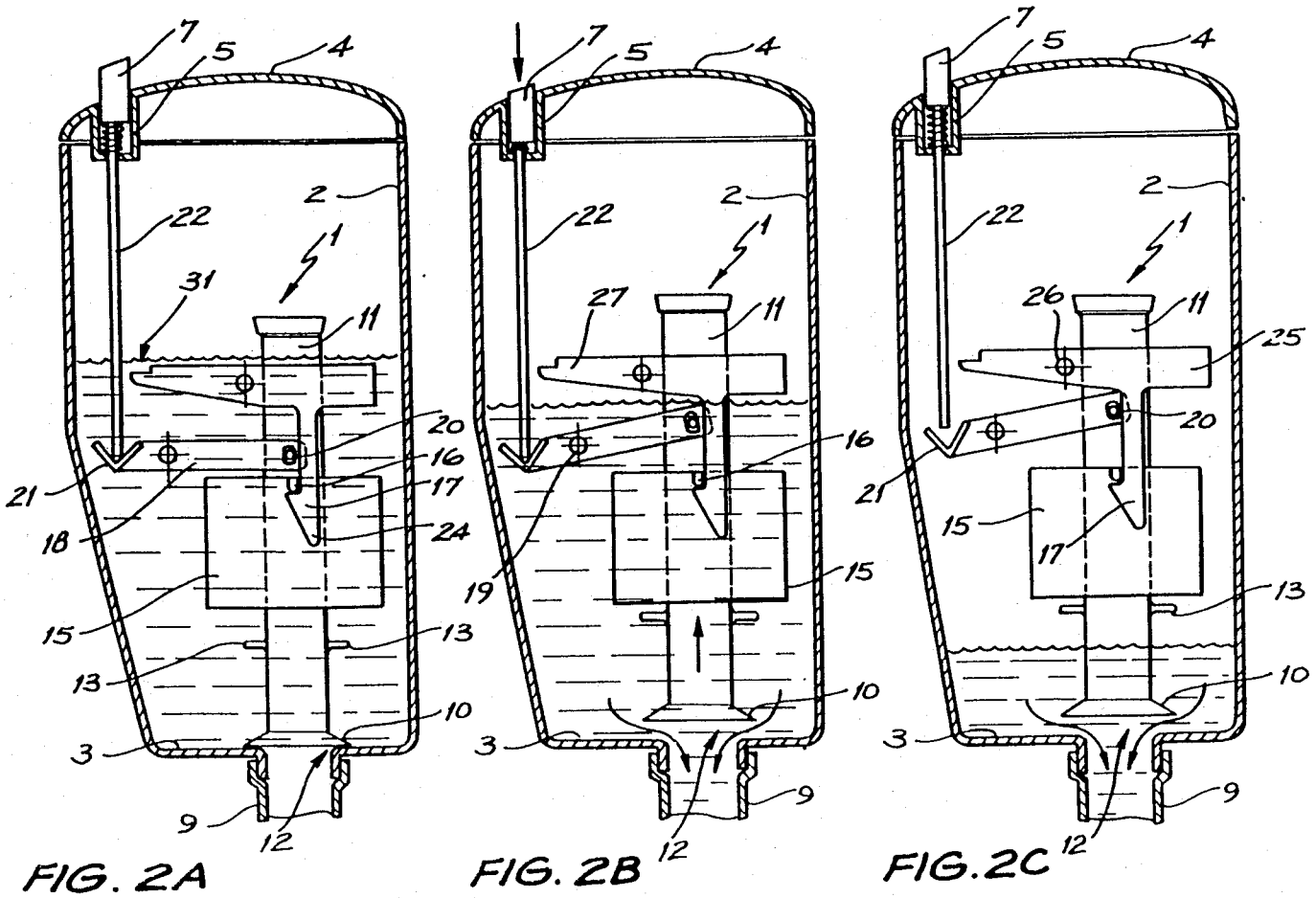
Figures 3A, 3B, 3C:
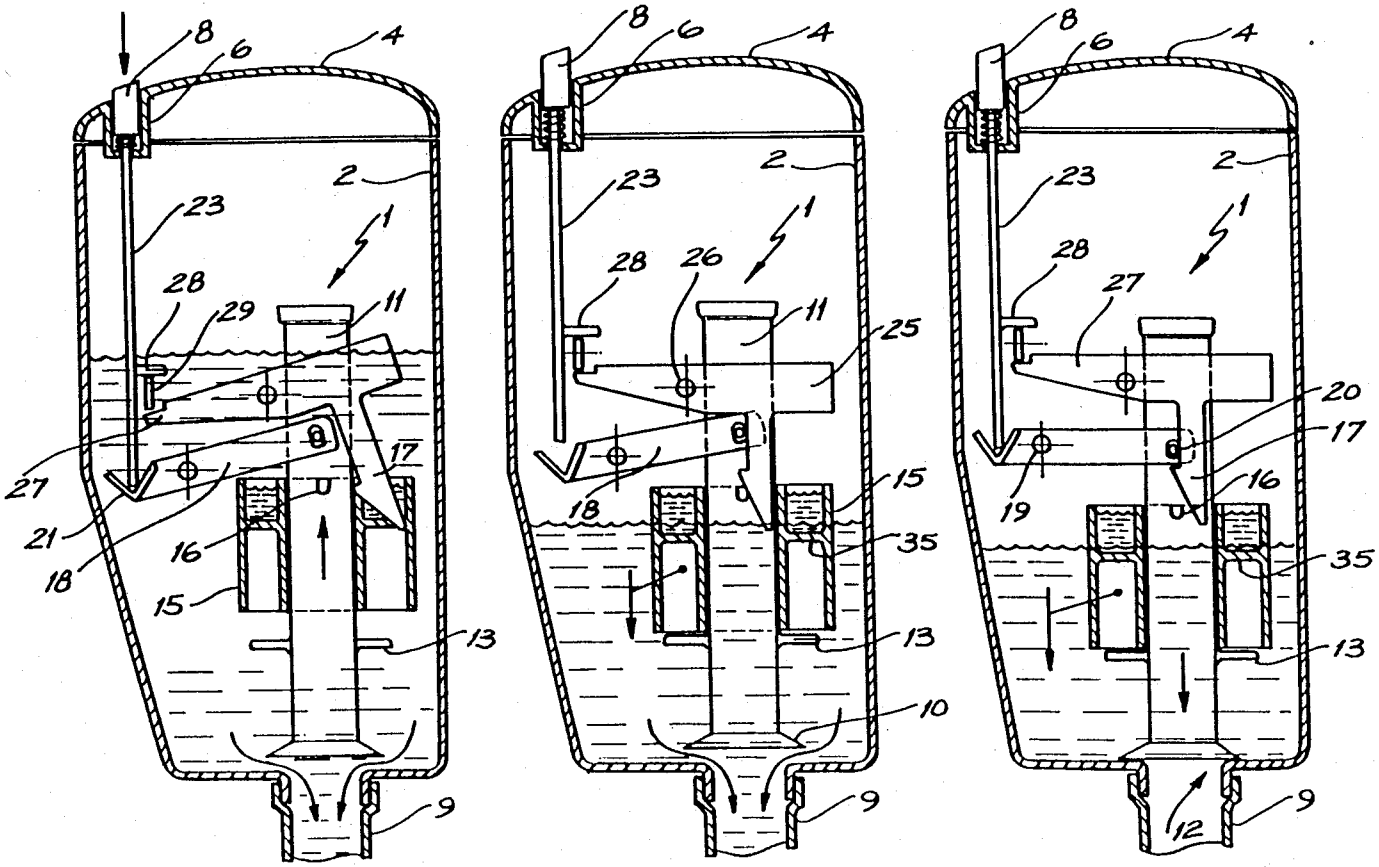

One embodiment of the present invention will now be described with reference to the drawings in which:

FIG. 1 is a schematic perspective view of the apparatus of the preferred embodiment, a portion of the float being cut away and only a portion of the floor of the cistern being illustrated, FIGS. 2A to 2C are identical longitudinal cross-sections through the cistern of the preferred embodiment illustrating a full flush operating sequence for a cistern incorporating the mechanism of FIG. 1 and, FIGS. 3A to 3C are views similar to FIGS. 2A to 2C but taken along a section line spaced therefrom, and illustrating a partial flush sequence for the mechanism of FIG. 1.

As best seen in FIGS. 2A-C and 3A-C, the cistern mechanism 1 is mounted within a substantially conventional cistern 2 having a floor 3. The cistern 2 also has a cover 4 having a pair of recesses 5, 6 within each of which one of a pair of spring loaded operating buttons 7 and 8 is respectively located.

The cistern floor 3 is provided with an outlet 9 in substantially conventional fashion which is able to be closed by a generally annular seal 10 carried at the lower end of a hollow stem 11. The seal 10 and outlet 9 together constitute a flush valve 12 whilst the hollow stem 11 constitutes an overflow pipe through which water can pass to the outlet 9 should the level of water in the cistern exceed the intended maximum level 31 (FIG. 2A). The stem 11 carries two projections 13 adjacent its lower end.

As best seen in FIG. 1, a generally rectangular float 15 is slidably mounted on the stem 11. The float 15 is illustrated in its higher operating position in FIG. 1 in which a protrusion 16 on the upper edge of the float 15 is releasably engaged with a latch member 17. Whilst the latch member 17 limits the downward movement of the float 15 when engaged with the protrusion 16, the upward movement of the float 15 is limited by engagement of the float 15 with a pair of lever arms 18 pivoted about stationary pivot 19 and pivotably connected to the stem 11 at 20.

As best seen in FIG. 1, the lever arms 18 are connected together at their ends remote from the stem 11 by a V-shaped channel member 21 which receives the lower ends of two connecting rods 22 and 23. The upper ends of the connecting rods 22, 23 are respectively connected to the operating buttons 7 and 8.

As also best seen in FIG. 1, a generally rectangular frame 25 from which the latch member 17 depends is pivotably mounted at 26 and includes a cantilever arm 27. The latch member 17 includes a ramp or inclined surface 24. The connecting rod 23 includes a lug 28 which is able to engage the arm 27 via a link 29 pivoted at 30. The arms 18, frame 25 and link 29 are respectively pivoted relative to the cistern 2 by pivots 19, 26 and 30 which engage the interior of the cistern in substantially conventional fashion.

The operating sequence of the cistern mechanism 1 will now be described with reference to FIGS. 2A to 2C inclusive which illustrate the full or normal flush sequence. In the situation illustrated in FIG. 2A, the cistern 2 is filled with water to its intended maximum level 31. In this condition, the float 15 is submerged but the protrusion 16 is retained by the latch member 17.

If the operating button 7 is now depressed as indicated in FIG. 2B, the connecting rod 22 depresses V-shaped channel member 21 and therefore turns lever arms 18 about pivot 19 so as to raise the stem 11. As a consequence, water flows past the seal 10 and into the outlet 9 since the flush valve 12 is effectively opened by the raising of stem 11.

As indicated in FIG. 2C, the button 7 is returned to its rest position by its associated spring. When the level of water within the cistern 2 has dropped to the level indicated in FIG. 2C, the force of water passing through the flush valve 12 is no longer sufficient to maintain the seal 10 and stem 11 in the raised position. Thus, the stem 11 moves downwardly under its own weight therefore closing seal 10 against the outlet 9 to close the flush valve 12. The cistern 2 is then automatically re-filled by any conventional mechanism such as a float valve (not illustrated).

Where a small volume flush is required, from the initial position illustrated in FIG. 2A, the button 8 is depressed as illustrated in FIG. 3A. As a consequence, connecting rod 23 moves downwardly thereby pivotting the V-shaped channel member 21 and lever arms 18 about pivot 19 as before so as to raise stem 11. In addition, the lug 28 on connecting rod 23 via link 29 depresses the free end of cantilever arm 27 which tilts the frame 25 about the pivotal mounting 26. As a consequence, the latch member 17 moves in an anti-clockwise direction as seen in FIG. 3A thereby releasing the protrusion 16 of the float 15.

As a result of the lifting of the stem 11, the flush valve 12 opens as before and water drains from the cistern 2 through the outlet 9 until the upper portions of the float 15 begin to protrude above the level of water within the cistern 2.

The situation illustrated in FIG. 3B is then reached where the button 28 and connecting rod 23 have been returned to their rest positions thereby allowing the frame 25 and latch member 26 to pivot back into their rest positions. Similarly link 29 pivots back into its rest position. As the water level drops within the cistern 2, the float 15 slides downwardly along the stem 11 until the lower end of the float engages the projections 13 extending from the stem 11. This engagement limits the downward travel of the float 15 relative to the stem 11 and instead moves the stem 11 downwardly so as to prematurely reach the position illustrated in FIG. 3C where the flush valve 12 is closed.

It will be seen from FIG. 3C that the flushing action has been completed but a substantial volume of the water originally present in the cistern 2 still remains. As a consequence, the volume of the partial flush initiated by operating button 8 is very much less then that of the full flush initiated by operation of button 7.

It will be apparent to those skilled in the art that as the cistern 2 is refilled the float 15 rises upwardly along the stem 11 so as to move the protrusion 16 past the inclined surface 24 of the latch member 17. As a consequence, the protrusion 16 and latch member 17 are thus re-engaged and the cistern 2 is thus returned to the initial condition illustrated in FIG. 2A.

As best seen in FIGS. 3A-C the float 15 is provided with a generally horizontal web 35 which joins the inner and outer walls of the float 15. Since the volume above the web 35 retains water, whilst the volume below the web 35 retains air and therefore provides the buoyancy for the float 15, by altering the position of the web 35 relative to the top of the float 15 and by also altering the length of the float 15, the buoyant force of the float 15 applied by protrusion 16 to the latch member 17, and the gravitational force of the float 15 applied to the projections 13 can be adjusted to an optimum value.

Furthermore, it will be apparent that the stem 11 fulfills three functions. The first is as an operating member for the seal 10, the second is as a slide for the float 15, and the third is as an overflow pipe. As a consequence of this multi-function component, a having in component pieces, and hence both fabrication costs and assembly time, is achieved. Furthermore, the arrangement of the stem 11 enables the buttons 7, 8 to be centrally located in the cover 4 which is aesthetically pleasing.

The foregoing describes only one embodiment of the present invention and modifications, obvious to those skilled in the art, can be made thereto without departing from the scope of the present invention.

For example, each of the operating mechanisms interconnecting the latch member 17 and lever arms 18 with the operating buttons 7, 8 can be varied as desired in order to achieve any aesthetic purpose. Also the pivots 19, 26 and 30 can be provided either by rods protruding from the interior side walls of the cistern, or by use of a separate frame.

What I claim is:

1. A dual flush cistern mechanism comprising a substantially vertical stem mounted for substantially vertical movement above a flush valve of said cistern and having a flush valve seal located at its lower end; a float slidably mounted on said stem intermediate the ends thereof; a first lever arm pivotably connected to said stem at a location spaced from a first pivot in said cistern for said first lever arm, and being pivotable by each of a first and a second operating mechanism to raise said stem to open said flush valve; a second lever arm pivotable by said second operating mechanism about a second pivot in said cistern and carrying a latch member releasably engageable with said float in a high operating position, and a projection extending from said stem to limit the travel of said float into a low operating position; wherein said first operating mechanism is operable to raise said stem with said float retained in said high operating position by said latch member to open said flush valve for a first duration; and wherein said second operating mechanism is operable to substantially simultaneously raise said stem to open said flush valve to drain water from said cistern and release said latch member whereby said float drops with the water level in said cistern until said float engages said stem projection to move said stem downwardly and close said flush valve before the expiration of said first duration, said float being buoyantly movable from said low to said high position to re-engage said latch member with said float when said cistern is re-filled with water, and said first and second pivots each having a longitudinal axis which is stationary with respect to said cistern.

2. A mechanism as claimed in claim 1 wherein said first lever arm comprises a pair of levers having an upwardly opening V-shaped channel member extending across said pair of levers at one end, the other end of said levers being pivotally connected to said stem and said first pivot being located between the ends of said pair of levers.

3. A mechanism as claimed in claim 2 wherein said cistern has a top and said first operating mechanism comprises a first spring loaded button mounted in said top and a first connecting rod extending between said first button and said channel member, whereby depressing said first button pivots said pair of levers to raise said stem.

4. A mechanism as claimed in claim 3 wherein said second operating mechanism comprises a second spring loaded button mounted in said top and a second connecting rod extending between said second button and said channel member, said second connecting rod having a lug engageable with said second lever arm following depressing of said second button to pivot said second lever arm about said second, pivot and release said latch member.

5. A mechanism as claimed in claim 4 wherein said lug engages said second lever arm via a link pivoted adjacent it mid point, said lug depressing one half of said link to move said second lever arm, and said link returning to its original level position under the weight of the other half of said link.

6. A mechanism as claimed in claim 1 wherein said stem is hollow and said flush valve has a seal which is substantially annular whereby said stem comprises an overflow pipe for said cistern.

7. The mechanism as claimed in claim 6 wherein said stem has a rectangular cross-section.

8. A mechanism as claimed in claim 1 wherein said float is an open ended tube having an interior sleeve through which said stem passes and a web which connects said sleeve and tube to provide two volumes, an upper one which retains water and a lower one which retains air to respectively provide oppositively directed gravitational and buoyant forces.

9. A mechanism as claimed in claim 1, wherein said first and second pivots engage the interior of the cistern.

* * * * *